United States Patent [19]

Chapnick

[11] Patent Number: 4,823,483

[45] Date of Patent: Apr. 25, 1989

[54] SHOE INSERT AND LAMINATING METHOD

[76] Inventor: Bernard Chapnick, 3 Pasture Rd., Beverly, Mass. 01915

[21] Appl. No.: 910,656

[22] Filed: Sep. 23, 1986

[51] Int. Cl.[4] ..... A43B 13/38

[52] U.S. Cl. ..... 36/43; 36/44

[58] Field of Search ..... 36/44; 12/142 N, 146 M; 264/46.4, 297.4, 320, 332

[56] References Cited

U.S. PATENT DOCUMENTS

| | | | |
|---|---|---|---|
| 3,233,348 | 2/1966 | Gilkerson | 36/44 |
| 4,054,706 | 10/1977 | Shapiro | 36/44 |
| 4,062,131 | 12/1977 | Hsiung | 36/44 |
| 4,187,621 | 2/1980 | Cohen | 36/44 |
| 4,296,053 | 10/1981 | Doerer et al. | 36/44 |
| 4,461,099 | 7/1984 | Bailly | 36/44 |
| 4,541,186 | 9/1985 | Muvihill | 36/44 |
| 4,586,273 | 5/1986 | Chapnick | 36/44 |
| 4,668,729 | 5/1987 | Kataoka | 264/297.4 |
| 4,674,204 | 6/1987 | Sullivan et al. | 36/44 |
| 4,674,205 | 6/1987 | Anger | 36/44 |

*Primary Examiner*—Steven N. Meyers

*Attorney, Agent, or Firm*—Wolf, Greenfield & Sacks

[57] ABSTRACT

A shoe insert and a laminating methods are provided. A first layer of cellular thermoplastic foam and a second layer of cellular thermoplastic foam are laminated together in facing relation to form a unitary insert by the application of heat and pressure after each of the layers had been previously formed as a separate unit.

29 Claims, 4 Drawing Sheets

FIG. 2
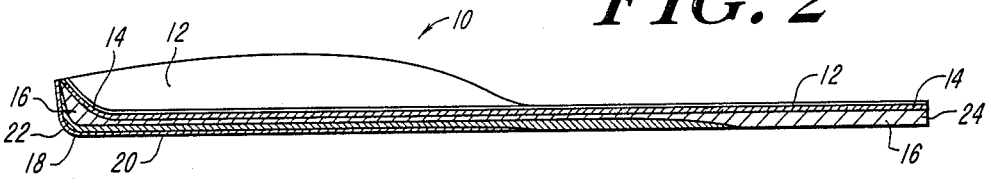
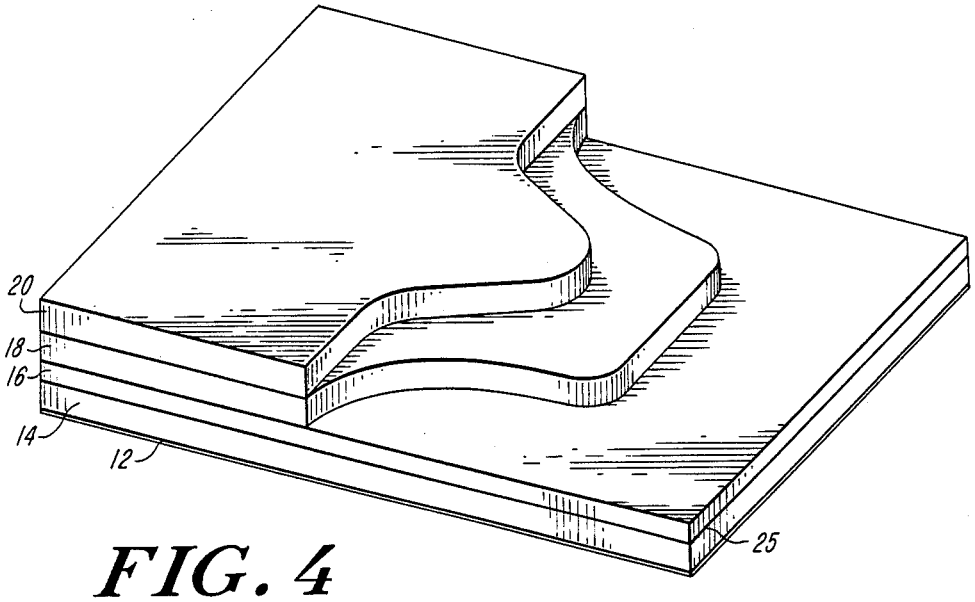
FIG. 4
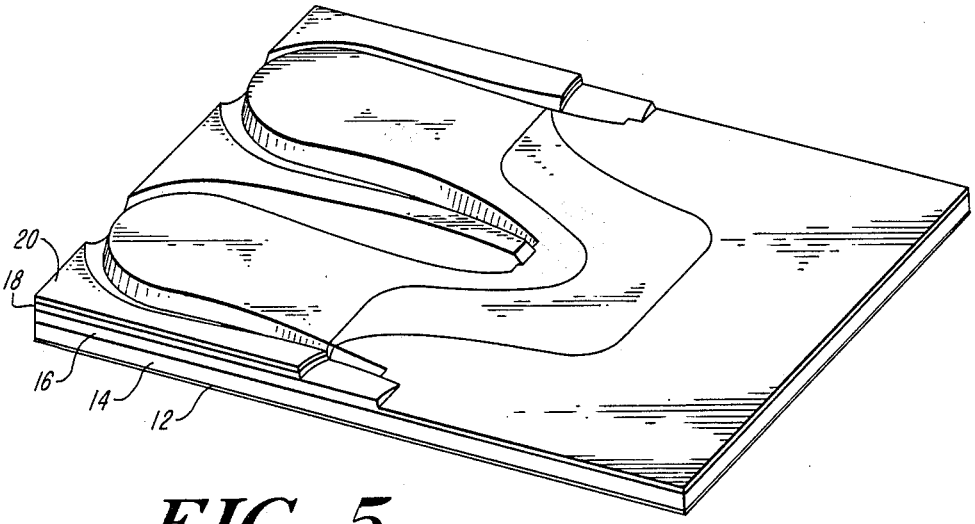
FIG. 5

SHOE INSERT AND LAMINATING METHOD

BACKGROUND OF THE INVENTION

This invention relates generally to shoe inserts and in particular to a laminated shoe insert and a laminating method.

Inserts are added to shoes to provide better support and comfort to the wearer. They may be used with virtually all types of shoes, from high performance athletic shoes to special orthopedic shoes or casual shoes. Inserts are typically made by the expansion molding of polyurethane-type materials. For example, a polyurethane foam is poured into a mold where it expands in an exothermic reaction to form an insert having the shape of the mold cavity. Sometimes a sock-lining fabric is put in the mold on top of the polyurethane foam and is bound to the foam as the foam exothermically expands and cures in the mold.

Since different regions of the sole of the foot are subject to different forces, it is desirable to make shoe inserts having regions of differing durometer or density to provide localized regions of support, shock absorption and cushioning. For example, it is sometimes desirable to have a greater degree of support in the heel area. One way to accomplish this is to vary the thickness of the expansion molded shoe insert making the heel region thicker than the other regions. Another way is to combine the expansion molded foam with a structural support member. For example, a preformed heel support may be glued or otherwise attached to the insert after the insert is formed. Alternatively, the preformed heel support may be secured to a sock-lining fabric and then the heel support and fabric may be placed in the mold together with the polyurethane foam. The heel support and fabric are then attached to the polyurethane foam during the exothermic reaction in the mold. Likewise, sheets of various porous products such as Poron and Latex have been exothermically bound to polyurethane foam as the foam cures in the mold to provide the shoe insert with better shock distribution and comfort. Again, a fabric is bound to the formed sheet of Poron or Latex and then the combination is placed in the mold with the foam.

The prior art has several drawbacks. Most notable is the unacceptable variation in the size of each insert manufactured according to exothermic expansion molding techniques from the same mold. Inserts manufactured according to typical methods have thicknesses that may vary up to 30%. However, many shoe manufacturers require less than 8% variation in the thickness of inserts for a particular size shoe to insure a properly fitting shoe or pair of shoes. The degree of variation in the thickness of shoe inserts made according to the prior art can result in the rejection of as many as 50% of the inserts for a given size at great expense and waste to the manufacturer.

The prior art also does not provide an easy and reliable way of making a single shoe insert having a variable durometer and density. Varying the thickness of the polyurethane foam is unsuitable because the variance usually causes the fit of the shoe to vary accordingly. Strengthening the heel region by attaching a heel support to a premolded polyurethane shoe insert outside of the mold is costly and time-consuming. Attaching the heel support during the exothermic molding process is impractical since the foam has a tendency to flow around the heel making it difficult to properly locate the heel support.

Exothermically attaching a sheet of Poron or Latex to polyurethane foam in the mold also is problematic. The polyurethane foam tends to seep into the pores of and stiffen the Poron and Latex thereby reducing the usefulness of the Poron and Latex. The invention overcomes these drawbacks and has other advantages over the prior art.

It is an object of the invention to provide a method for substantially reducing the dimensional variation usually created when manufacturing shoe inserts.

Another object of the invention is to provide a novel method for making a shoe insert from sheets or layers of cellular thermoplastic foam.

Another object of the invention is to provide a method for making a shoe insert having logistically designated areas of varying preselected durometer and density.

Another object of the the invention is to provide a method for precisely controlling the placement of support, shock absorbing and cushioning members in manufacturing a shoe insert.

Another object of the invention is to provide a unitary shoe insert having a smooth surface and regions of varying density or durometer.

Another object of the invention is to provide a shoe insert made from sheets or layers of cellular thermoplastic foam.

Another object of the invention is to provide a shoe insert having a foam layer and a porous layer wherein the pores of the porous layer are substantially free of any foam.

Another object of the invention is to provide a method for predetermining the thickness, durometer and density of selected portions of a shoe insert.

According to the invention, a shoe insert has two layers of cellular thermoplastic foam. One layer is different in size, density or durometer from the other layer. The layers are laminated together in facing relation to form the laminated shoe insert by the application of sufficient heat and pressure after each of the layers had been formed as a separate unit.

Also according to the invention, a shoe insert has at least two layers, one layer being a cellular thermoplastic foam and the other layer being a material useful for imparting a desired characteristic to the shoe insert. The two layers are laminated together in facing relation to form a unitary insert by the application of heat and pressure after each of the layers had been formed as a separate unit.

Also according to the invention, a shoe insert is formed by positioning a first and second layer of cellular thermoplastic foam in face-to-face relation between two mold halves which together form a mold cavity, and compression molding the first and second layers together to form a unitary shoe insert having the shape of the mold cavity.

Also according to the invention, two preformed layers of cellular thermoplastic foam are placed in face-to-face relation between the two mold halves which together form a mold cavity and the two halves are brought together to heat compression-mold the two layers together to form a unitary article having regions of varying durometer or density and having the shape of the mold cavity.

BRIEF DESCRIPTION OF THE DRAWINGS

FIG. 2 is a cross section along lines 2—2 of FIG. 1;

FIG. 4 is a view of the assembled laminates of FIG. 1 prior to molding and cutting;

FIG. 5 shows the laminates of FIG. 4 after compression molding but prior to cutting;

DETAILED DESCRIPTION OF PREFERRED EMBODIMENT

Figure 1:
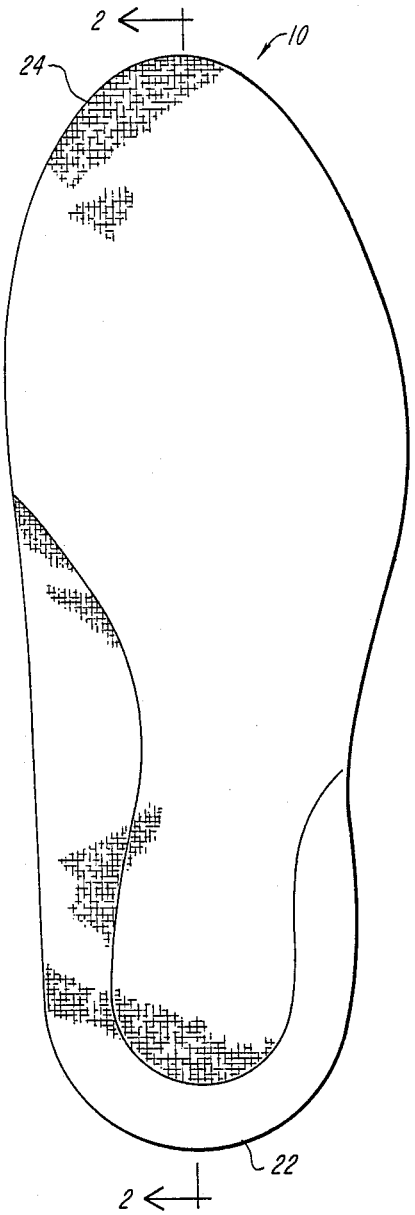
FIG. 1 is a top view of a preferred embodiment of applicant's invention.

As illustrated in FIGS. 1 and 2, the preferred embodiment of applicant's shoe insert 10 is a five-layer compression-molded laminate. Going from top to bottom, the top being the surface of the shoe insert 10 intended for contact with the foot, there is a full fabric layer 12, a full cushion layer 14, a full support layer 16, a metatarsal partial support layer 18 and a bottom or heel partial support layer 20. By full layer, it is meant that the layer extends completely across the length and width of the shoe insert 10 at all points. A partial layer extends less than completely across the length, the width or both the length and width of the shoe insert 10. The shoe insert 10 has a heel end 22 and a toe end 24.

The top fabric layer 12 provides the surface upon which the foot rests. Such fabric layers are commonly used to provide a proper contact surface for the foot and an aesthetically pleasing covering for the shoe insert 10. The particular fabric applicant employs is Trylon, a 3 bar warp-knitted product containing nylon and polyester obtained from Apex Mills Corp. of Lynbrook, N.Y. 11563. Although many other fabrics may be used, the fabric chosen must be capable of withstanding the temperature and pressure conditions of the compression molding discussed below.

The full fabric layer 12 is bonded in face-to-face relation to the full cushion layer 14 which also extends completely from the heel end 22 to the toe end 24 of the shoe insert 10. The full cushion layer 14 is bonded in face-to-face to the full support layer 16 which extends completely from the heel end 22 to the toe end 24 of the shoe insert 10. The full support layer 16 is bonded in face-to-face relationship along a portion of its length extending from the heel end 22 toward the toe end 24 to the metatarsal partial support layer 18. The metatarsal partial support layer 18 is bonded in face-to-face relation along a portion of its length extending from the heel end 22 toward the toe end 24 of the shoe insert to the heel partial support layer 20.

Figure 3:
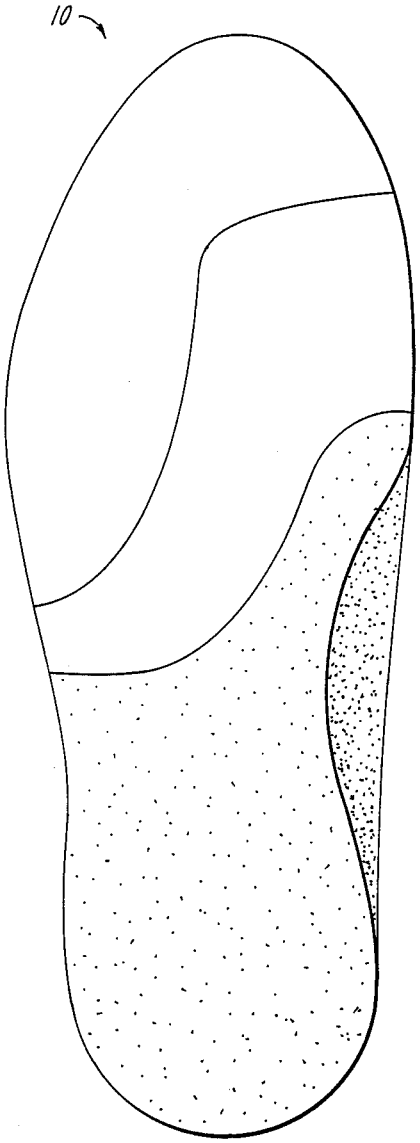
FIG. 3 is a bottom view of FIG. 1.

FIG. 3 best illustrates the shape of the various layers of the shoe insert 10. The fabric, cushion, and support layers 12, 14, 16 extend completely across the shoe insert from the heel end 22 to the toe end 24. They are shaped to conform to the basic outline of the foot. The metatarsal partial support layer 18 extends across the full width of the shoe insert 10 from the heel end 22 to about the mid-line halfway between the heel end 22 and the toe end 24. It then extends approximately halfway across the width of the shoe insert 10 from the mid-line of the shoe insert 10 to a point on the insert that would correspond approximately to the ball region of the foot. The heel partial support layer 20 is completely contained within the area defined by the metatarsal support layer 18. It extends fully across the width of the shoe insert 10 from the heel end 22 to just below the mid-line region and extends from the point toward the toe end 24 along an edge of the shoe insert 10 corresponding to the arch region of the foot. It ends prior to the point corresponding to the ball region of the foot defining the boundary of the metatarsal partial support layer 18.

The portion of the shoe insert 10 having only three layers, the full fabric, cushion and support layers 12, 14 and 16, respectively, defines the region of the insert that is the softest and is indicated in FIG. 3 by the single cross hatching. The portion of the shoe insert 10 having all five layers, including the metatarsal partial support layer 18 and the heel partial support layer 20, is the hardest region and is indicated by the double cross hatching and dots. The portion of the insert having four layers, including the metatarsal partial support layer 18 but not including the heel support layer 20, is of an intermediate density and is indicated by the double cross hatching. In this manner, a shoe insert 10 is provided that has the greatest amount of support in the heel region which receives the greatest amount of shock during normal walking, an intermediate amount of support in the arch region and softer cushioning in the toe region.

The method for making applicant's shoe insert is illustrated in FIGS. 4 and 5. The four layers or sheets of preformed cellular thermoplastic foam and the layer of fabric are stacked in sequence prior to compression molding. It is most preferable to use a thin layer of adhesive 25 between each layer to promote bonding, although such an adhesive layer is not required since adequate bonding can be achieved by the compression molding without adhesive. Preferable adhesives are those which dry to a non-tacky state after application and which become tacky again with the application of heat during the compression-molding step. With such adhesives it is necessary to put a layer of adhesive on only one surface of the face-to-face surfaces of two foam sheets prior to compression molding. Applicant uses an ethylene vinyl acetate base adhesive, sold under product designation 1954F by T. H. Glennon Company of Lawrence, Mass.

In the preferred embodiment shown in FIG. 4, the fabric layer is Trylon. The full cushion layer is a ½" layer of G135, an open-celled, flexible, polyurethane foam sheet obtained from Crest Foam Co. of Moonachie, N.J. It has a density of 3.5 lbs./cu ft. and an IFD of 105 and an air flow of 1 cu. ft/min., all determined according to ASTM D-3574. The full support layer is a ¼" layer of G170, an open-celled flexible polyurethane foam sheet also obtained from Crest Foam. It has a density of 5 lbs./cu. ft. and an IFD of 105 and an air flow of less than 1 cu. ft./min. The metatarsal partial support layer is cut from a ½" sheet of S80C, an open-celled flexible polyurethane foam sheet also obtained from Crest Foam. It has a density of 2 lbs/cu. ft., an IFD of 40 and an air flow of about 5 cu. ft./min. The heel partial support layer is a ½" layer of S80C obtained from Crest Foam. It should be recognized that the particular properties of the open-celled flexible polyurethane foam described in this preferred embodiment may vary greatly and are in no way meant to limit the scope of the invention. It should also be recognized that the foam is not limited to polyurethane or open-celled foams. Rather, it may be any cellular thermoplastic foam that will not decompose under molding conditions including materials made from fibers that may be compressed.

The entire stack of fabric and cellular thermoplastic foam sheets is placed between the halves of a heated, contoured mold. In a preferred embodiment, the mold has two cavities, one for a left foot shoe insert and one for a right foot insert of the same size. In this manner, a pair of inserts can be compression-molded simultaneously. The stack is compressed in the mold under a pressure of 86 psi and a temperature of 400° Fahrenheit for two to two and a half minutes. The mold is then opened and the stack is removed from the mold. It should be recognized that these parameters may change greatly depending upon the particular materials and the tool design and applicant does not intend to limit the scope of his invention by the recitation of these particular parameters.

FIG. 5 illustrates the stack of FIG. 4 after compression molding but prior to being cut into the individual shoe inserts illustrated in FIG. 1. The portion of the stack that is compression-molded has the same size and shape as the mold cavities. Individual inserts then are cut from the molded material of FIG. 5 to fit various shoe sizes.

According to applicant's invention, the density of the various regions of the finished product can be determined prior to molding the shoe insert. The overall density of a particular region of the shoe insert equals the sum of the density times the thickness for each layer divided by the tool gap. For the above-described embodiment, the overall densities for the various regions, all having a tool gap of ¼", are as follows:

| Heel and Arch Region | Extended Arch Region | Toe Region |
|---|---|---|
| G135: ½ × 3.5 = 1.75 | G135: ½ × 3.5 = 1.75 | G135: ½ × 3.5 = 1.75 |
| G170: ¼ × 5.0 = 1.25 | G170: ¼ × 5.0 = 1.25 | G170: ¼ × 5.0 = 1.25 |
| S80C: ½ × 2.0 = 1 | S80C: ½ × 2.0 = 1 | |
| S80C ½ × 2.0 = 1 | | |
| TOTAL = 5 | TOTAL = 4 | TOTAL = 3 |
| Density (Lbs./Cu. Ft.) = 20 | = 16 | = 12 |

It should be apparent that the density of any given region of the shoe insert can be predetermined and precisely controlled according to applicant's invention.

Figure 6:
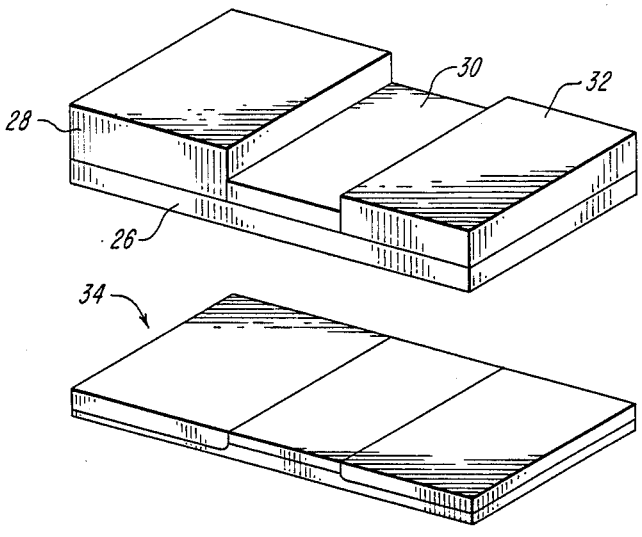
FIG. 6 is a schematic view of another embodiment of applicant's invention.

FIGS. 6 through 11 illustrate further embodiments of applicant's invention. As illustrated in FIG. 6, laminates of different thickness and density can be stacked adjacent to one another rather than being stacked in overlapping relationship to form a compression-molded laminate having the desired properties. In FIG. 6, a full base layer 26 of cellular thermoplastic foam is overlaid with a heel partial layer 28 of one thickness, an arch partial layer 30 of another thickness and a toe partial layer 32 of yet another thickness. The heel partial layer 28 is adjacent to but not overlapping with the arch partial layer 30 which in turn is adjacent to but not overlapping with the toe partial layer 32. The compression molded product 34 shown in 6B has a uniform thickness and a smooth surface, but has three regions, the heel, arch and toe, of varying density.

Figure 7:
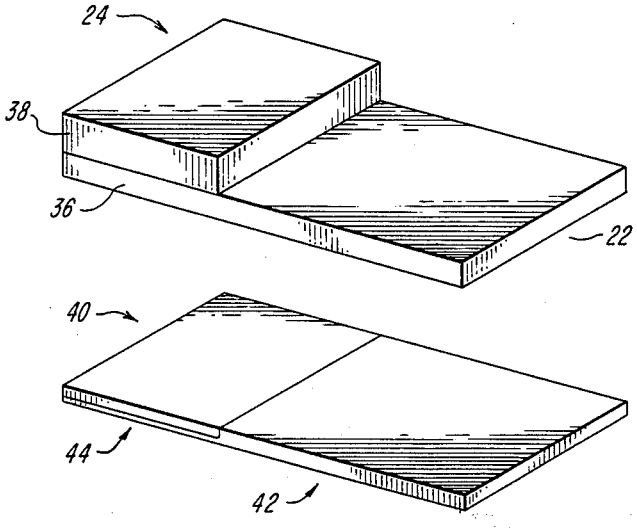
FIG. 7 is a schematic view of another embodiment of applicant's invention.
Figure 8:
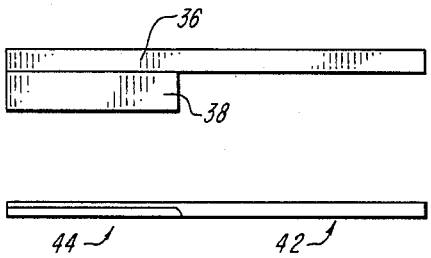
FIG. 8 is a schematic view of another embodiment of applicant's invention.

FIGS. 7 and 8 show that by reversing the top to bottom relationship of the stacked sheets of cellular thermoplastic foam compression-molded laminates having differing properties are achieved. In FIG. 7, a full layer 36 of a cellular thermoplastic foam having a lower density is overlayed by a partial layer 38 having a higher density. The compression-molded laminate 40 has a single layered region 42 consisting of the full layer at the toe end 22 and a doubled layered region 44 consisting of the partial layer 38 and the full layer 36 at the heel end 24. The double-layered region 44 has a higher density and durometer than the single layered region 42. Thus, the heel region is given greater support. The heel itself is placed in contact with the partial layer which is the softer layer of the laminate. Although it had the higher density prior to compression molding, it turns out that it is compressed to a lesser degree than the underlying full layer 36 during compression molding and has a higher density after molding.

By reversing the order of the layers as shown in FIG. 8, the heel end will again be provided with greater support toe end, but the heel will contact the surface of the full layer 36 which is the layer of the laminate compressed to a greater degree and having the higher density. It is not meant to be suggested that one embodiment is more desirable than the other, only that the properties of the laminate can be carefully controlled according to applicant's invention.

Figure 9:
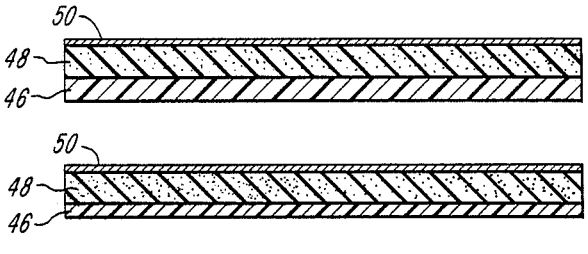
FIG. 9 is a schematic view of another embodiment of applicant's invention.

According to the embodiment of applicant's invention shown in FIG. 9, a shoe insert having a highly-porous ventilation layer is provided. This layer contains approximately 15 pores per square inch. According to prior art expansion molding techniques for making shoe inserts, it was virtually impossible to properly make a shoe insert with such a porous layer because the liquid polyurethane foam would seep into and throughout the pores of the porous layer during the expansion molding process. Because applicant compression molds sheets of pre-expanded cellular thermoplastic foams rather than using liquid foam, the problem with seeping into the pores is eliminated. In FIG. 9, the shoe insert has three layers, a base layer 46 of a cellular thermoplastic foam, a highly porous intermediate layer 48 and a top fabric layer 50. The three layers are compression-molded and the highly-porous intermediate layer 48 is attached to and sandwiched between the base layer and the fabric layer with the pores of the intermediate layer 48 substantially free of any foam. The intermediate porous layer 48 provides for the circulation of air and moisture beneath the foot. The shoe may be constructed so that the pores of this intermediate layer communicate with ventilation holes in a shoe. The porous intermediate layer also may be Latex or Poron for providing increased shock distribution or comfort.

Figure 10:
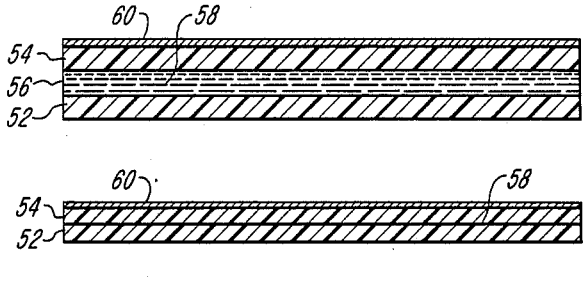
FIG. 10 is a schematic view of another embodiment of applicant's invention.

In FIG. 10, applicant provides an odor-absorbent shoe insert. The shoe insert is formed by compression molding four layers. Two layers of cellular thermoplastic foam 52, 54 sandwich a polyethylene sack 56 containing an odor-absorbent chemical 58. A fabric layer 60 overlays one of the cellular thermoplastic foam layers. When this stacked assembly is compression-molded, the polyethylene sack 56 virtually disintegrates and the chemical is captured between the cellular thermoplastic foam layers 52, 54.

Figure 11:
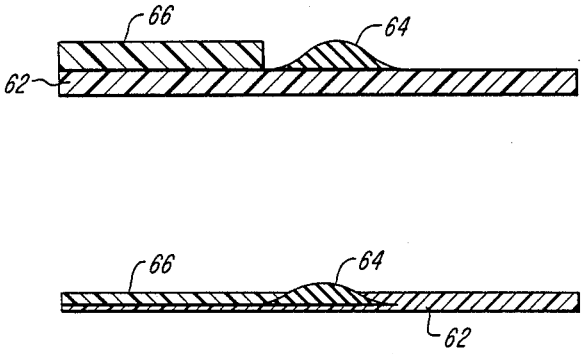
FIG. 11 is a schematic view of another embodiment of applicant's invention.

FIG. 11 shows an embodiment of applicant's invention including a supplemental structural element compression-molded to at least one cellular thermoplastic foam layer. In FIG. 11, there is a base layer 62 of cellular thermoplastic foam, an arch support 64 and a heel region layer 66 of cellular thermoplastic foam. The arch support 64 may be made of any material capable of withstanding the temperature and pressure conditions of the compression-molding. Commonly used products for footwear are made from natural or synthetic rubbers of thermoplastics. The arch support 64 is secured to the cellular thermoplastic foam layers 62 and 66 during the compression molding step. The material of the arch support 64 should be such that it is capable of bonding with the cellular thermoplastic foam under the temperature and pressure conditions of compression molding or the overall configuration of the shoe insert may be such that layers of cellular thermoplastic foam capture the supplemental structural element. Where the supplemental structural element is captured, it would not be necessary that the material from which it is made be capable of binding with the cellular thermoplastic foam.

It should be understood that the foregoing description of the invention is intended merely as illustrative thereof and that other embodiments and modifications may be apparent to those skilled in the art without departing from its spirit. For example, a shoe insert may be compression molded from a single sheet of cellular thermoplastic foam rather than from multiple sheets. The variation in the size of each insert so formed would be greatly reduced.

Having thus described the invention, what we desire to claim and secure by letters patent is:

What is claimed is:

1. A molded shoe insert comprising, a first layer of a heat-compressed, polyurethane, cellular thermoplastic foam, and a second layer of a heat-compressed, polyurethane, cellular thermoplastic foam, the first and second layers being laminated directly together in facing relation, permanently compressed and shaped to form a unitary insert by the application of heat and pressure from a heated mold after each of the layers had been previously formed as a separate unit.

2. A shoe insert as claimed in claim 1 wherein the first and second layers are of different durometers.

3. A shoe insert as claimed in claim 1 wherein the first and second layers are of different densities.

4. A shoe insert as claimed in claim 1, wherein the first and second layers are of different sizes.

5. A shoe insert as claimed in claim 1 wherein said first and second layers have facing surfaces and the facing surface of said first layer overlaps with only a portion of the facing surface of said second layer.

6. A shoe insert as claimed in claim 4 wherein the shoe insert has a surface and the first and second layer meet at a seam along the surface, and the surface across the seam is smooth.

7. A shoe insert as claimed in claim 1, the first layer having a higher durometer or density than the second layer and wherein the second layer is permanently compressed relative to its initial thickness to a greater extent than is the first layer.

8. A shoe insert as claimed in claim 1 further comprising a third layer, said third layer being an adhesiver layer disposed between the first and second layers of cellular thermoplastic foam.

9. A shoe insert as claimed in claim 1 further comprising a supplemental structural element compression molded to at least one of the first and second layers during the lamination of the first and second layers.

10. A shoe insert comprising, a first layer of a heat-compressed polyurethane cellular thermoplastic foam, and a second layer of material desireable for imparting a particular property to a shoe insert and capable of withstanding the temperature and pressure conditions of compression molding, at 400° Fahrenheit, the first and second layers being laminated together in facing relation, permanently compressed and shaped to form a unitary insert by the application of heat and pressure from a heated mold after each of the layers had been previously formed as a separate unit.

11. A shoe insert as claimed in claim 10 wherein the second layer is a layer of highly-porous thermoplastic material.

12. A shoe insert comprising, a first layer of a heat-compressed polyurethane cellular thermoplastic foam, a layer of an odor-adsorbent chemical, and a second layer of a heat-compressed polyurethane cellular thermoplastic foam, the first and second layers sandwiching the layer of odor-adsorbent material and being laminated together in facing relation, permanently compressed and shaped to form a unitary insert by the application of heat and pressure from a heated mold after each of the layers had been previously formed as an integral unit.

13. A shoe insert as claimed in claim 12 wherein the odor-adsorbent chemical was contained in a sack prior to application of heat and pressure and the sack disintegrated upon the application of heat and pressure.

14. A method for forming a unitary shoe insert comprising, positioning a first and a second layer of cellular thermoplastic foam in face-to-face relationship between two mold halves which halves define a mold cavity, heating said mold halves to a temperature sufficient to permanently shape the cellular thermoplastic foam, and compression molding the first and second layers for a period of time sufficient to form a unitary shoe insert having the shape of the mold cavity.

15. A method for forming a unitary shoe insert as claimed in claim 14 comprising, applying a layer of adhesive to at least one of the layers of cellular thermoplastic foam.

16. A method as claimed in claim 14 further comprising releasing the insert from the mold cavity without cooling the mold.

17. A method as claimed in claim 16 wherein said first and second layer are polyurethane cellular thermoplastic foam and are placed in face-to-face relationship between the mold halves.

18. A method as claimed in claim 7 wherein said mold haves are heated to a temperature to about 400° Fahrenheit and said polyurethane layers are heat compressed in said mold for about 2 and ½ minutes.

19. A method for making a unitary shoe insert comprising, placing in face-to-face relation a first layer of a polyurethane cellular thermoplastic foam and a second layer of material desirable for imparting a particular property to a shoe insert and capable of withstanding the temperature and pressure conditions of compression molding, positioning said layers between two mold halves, which halves define a mold cavity, heating said mold halves to a temperature sufficient to permanently shape the polyurethane foam, and compression molding the first and second layers in said heated mold for a period of time sufficient to form a unitary shoe insert.

20. A method for making a unitary shoe insert as claimed in claim 19 wherein the material contains about 15 pores per square inch.

21. A method for making an article comprising, positioning a first and second layer of a polyurethane cellular thermoplastic foam in face-to-face relationship between two mold halves which halves, define a mold cavity, heating said mold halves to a temperature sufficient to permanently shape the polyurethane foam, and compression-molding the first and second layers in said heated mold for a period of time sufficient to form a unitary article having the shape of the mold cavity.

22. A method for making an article comprising, placing in face-to-face relation a first layer of a polyurethane cellular thermoplastic foam and a second layer of material desirable for imparting a particular property to the article and capable of withstanding the temperature and pressure conditions of compression molding, positioning said first and second layers between two mold halves, which halves define a mold cavity, heating said mold halves to a temperature sufficient to permanently shape the polyurethane foam, and compression molding the first and second layers in said heated mold for a period of time sufficient to form the article.

23. A molded shoe insert comprising, first and second layers of a heat-compressed polyurethane cellular thermoplastic foam with at least one of said layers shaped to support and cushion at least a portion of the foot, said layers integrally laminated and formed into a sole shape by compressing said layers in a heated mold, said layers having been initially formed of materials having densities and thicknesses such as to result in a composite sold wherein portions thereof formed by said different layers have different densities.

24. A method for forming a unitary shoe insert with odor-adsorbent properties comprising, positioning a polyethylene sack containing an odor-absorbant chemical between a first and a second layer of polyurethane cellular thermoplastic foam, positioning said layers and said sack between two mold halves which halves define a mold cavity, heating said mold halves to a temperature sufficient to permanently shape the polyurethane foam, and compression molding the layers and the sack in said heated mold for a period of time sufficient to cause disintegration of said sack and sufficient to form a unitary shoe insert having the shape of the mold cavity.

25. A method for forming a unitary shoe insert as claimed in claim 24 further comprising, releasing the insert from the mold cavity without cooling the mold.

26. A method for forming a unitary shoe insert comprising, selecting a plurality of polyurethane cellular thermoplastic sheets, stacking said sheets in face-to-face relationship such that a facing surface of at least one of said sheets does not overlap completely with the complementary facing surface of an adjacent sheet thereby forming an overlapping region and a non-overlapping region, positioning said stack between two mold halves which form a mold cavity such that at least a portion of said non-overlapping region and a portion of said overlapping region will be captured in the mold cavity, heating said mold halves to a temperature sufficient to permanently shape the polyurethane foam, and compression molding the stack for a period of time sufficient to form a unitary shoe insert having the shape of the mold cavity.

27. A method as claimed in claim 26 further comprising releasing the insert from the mold cavity without the mold.

28. A molded shoe insert manufactured from a first sheet of polyurethane foam having a first thickness and a second sheet of polyurethane foam having a second thickness comprising, a first layer of heat-compressed, polyurethane foam formed from at least a portion of said first sheet and having a thickness less than said first thickness, a second layer of heat-compressed, polyurethane foam formed from at least a portion of said second sheet and having a thickness less than said second thickness, and wherein said first and second layers are laminated together in facing relation to form a unitary insert, said insert being formed by the application of heat and pressure to said sheets from a heated mold.

29. A molded shoe insert as claimed in claim 28 wherein only a portion of said first layer of heat-compressed polyurethane foam overlaps in facing relation with said second heat-compressed layer.

* * * * *